US006851210B1

(12) United States Patent
Rose

(10) Patent No.: US 6,851,210 B1
(45) Date of Patent: Feb. 8, 2005

(54) ELECTRONIC SIGN ENCLOSURE HAVING A RAIL

(75) Inventor: Todd L. Rose, Elkton, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 09/943,043

(22) Filed: Aug. 29, 2001

(51) Int. Cl.[7] ..... G09F 15/00

(52) U.S. Cl. ..... 40/606.01; 40/607.13; 248/220.1; 256/65.14

(58) Field of Search ..... 40/606.01, 611.01, 40/651, 607.13, 662, 606.03, 666, 452, 564, 606, 611; 248/220.1, 220.21, 239; 256/59, 64, 65, 68, 65.14, 65.16; 182/113

(56) References Cited

U.S. PATENT DOCUMENTS

| | | | | | |
|---|---|---|---|---|---|
| 819,338 | A | * | 5/1906 | Claridge | 40/606 |
| 2,765,554 | A | * | 10/1956 | Anderson et al. | 40/612 |
| 2,867,306 | A | * | 1/1959 | Pick et al. | 190/115 |
| 3,863,899 | A | * | 2/1975 | Werner | 256/24 |
| 3,863,900 | A | * | 2/1975 | Dagiel et al. | 256/59 |
| 3,988,845 | A | * | 11/1976 | Boatman | 40/542 |
| 3,995,833 | A | * | 12/1976 | McLaughlin et al. | 256/59 |
| 4,263,736 | A | * | 4/1981 | Beierwaltes et al. | 40/452 |
| 4,669,577 | A | * | 6/1987 | Werner | 182/113 |
| 4,937,499 | A | * | 6/1990 | Hunte | 315/149 |
| 4,970,816 | A | * | 11/1990 | Trame | 40/552 |
| 5,259,089 | A | * | 11/1993 | Baur et al. | 16/444 |
| 5,353,891 | A | * | 10/1994 | Griek et al. | 182/45 |
| 5,497,573 | A | * | 3/1996 | Stadjuhar et al. | 40/564 |
| 5,522,540 | A | * | 6/1996 | Surman | 232/17 |
| 5,566,926 | A | * | 10/1996 | Voigt | 256/13.1 |
| 5,685,511 | A | * | 11/1997 | Ghany et al. | 248/201 |
| 5,803,420 | A | * | 9/1998 | Conway et al. | 248/231.41 |
| 5,924,367 | A | * | 7/1999 | Henke et al. | 108/108 |
| 6,015,124 | A | * | 1/2000 | Loy | 248/220.31 |
| 6,314,669 | B1 | * | 11/2001 | Tucker | 40/448 |
| 6,347,468 | B1 | * | 2/2002 | Mohamed | 40/564 |

* cited by examiner

*Primary Examiner*—Brian K. Green
(74) *Attorney, Agent, or Firm*—Hugh D. Jaeger

(57) ABSTRACT

An electronic sign enclosure with a mounted rail which mounts to the edge of a seating deck to serve as a mounting structure for electronic sign information and to serve as a safety barrier at the edge of the seating deck.

23 Claims, 4 Drawing Sheets

ELECTRONIC SIGN ENCLOSURE HAVING A RAIL

CROSS REFERENCES TO RELATED APPLICATIONS

None.

BACKGROUND OF THE INVENTION

1. Field of the Invention

The present invention relates to an electronic sign enclosure and, more particularly, to an electronic sign enclosure having a rail, the combination of which serves as a short wall or barrier at the edge of a balcony and as an electronic sign mounting structure.

2. Description of the Prior Art

Prior art electronic sign displays and enclosures have been provided and used often to display information in stadiums, arenas, large halls, and the like. Often electronic sign displays have been mounted at the edge of pre-existing ring or balcony structures above the first floor level at a position and level highly viewable to participants. Such mounting presented access problems, as the structure to which the electronic sign enclosure was secured formed an obstruction between service personnel on the balcony deck and the electronic sign enclosure. Servicing of the electronic sign in the enclosure often required that the entire enclosure be removed for servicing to gain access to the enclosed electronic components. Often, servicing of the electronic sign displays in the enclosures required the use of access devices such as ladders, cherry pickers, elevating devices or other elaborate and expensive devices due to the elevated position of the electronic sign display on the ring structure. Clearly what is needed is an electronic sign display enclosure which can also be used as a short wall or barrier at a balcony or ledge, which does not require expensive, cumbersome or dangerous methods for access, and which also minimizes, the time spent replacing or servicing the electronic sign display.

SUMMARY OP THE INVENTION

The general purpose of the present invention is an electronic sign enclosure having a rail which can replace or be utilized in lieu of traditional seating barrier structures. The electronic sign enclosure having a rail can be secured to the edge of a seating deck or balcony and acts as a barrier. The electronic sign enclosure having a rail located along and about an upper surface includes a series of upper and lower brackets located along the rearwardly facing enclosure surface each of which secures to metal mounting plates on the upper and lower surfaces at the edge of the seating deck. The electronic sign enclosure having a rail is of sufficient height to prevent people from accidentally falling over the edge of the seating deck. While serving as a safety barrier, the electronic sign enclosure can be accessed by maintenance personnel without the interference or hinderance of traditional seating deck barrier structure. The sight line across the sign is enhanced as the sign also acts as a vertical element with a rail.

According to one embodiment of the present invention, there is provided an electronic sign enclosure having a rail. Access to the sign is through a rear panel.

One significant aspect and feature of the present invention is an lectronic sign enclosure having a rail which secures to the edge of a seating deck.

Another significant aspect and feature of the present invention is an electronic sign enclosure having a rail.

still another significant aspect and feature of the present invention is an electronic sign enclosure having a rail which is used instead of a traditional barrier.

Yet another significant aspect and feature of the present invention is an electronic sign enclosure having a rail which can be accessed from the rear.

Having thus described embodiments and significant aspects and features of the present invention, it is the principal object of the present invention to provide an electronic sign enclosure having a rail.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
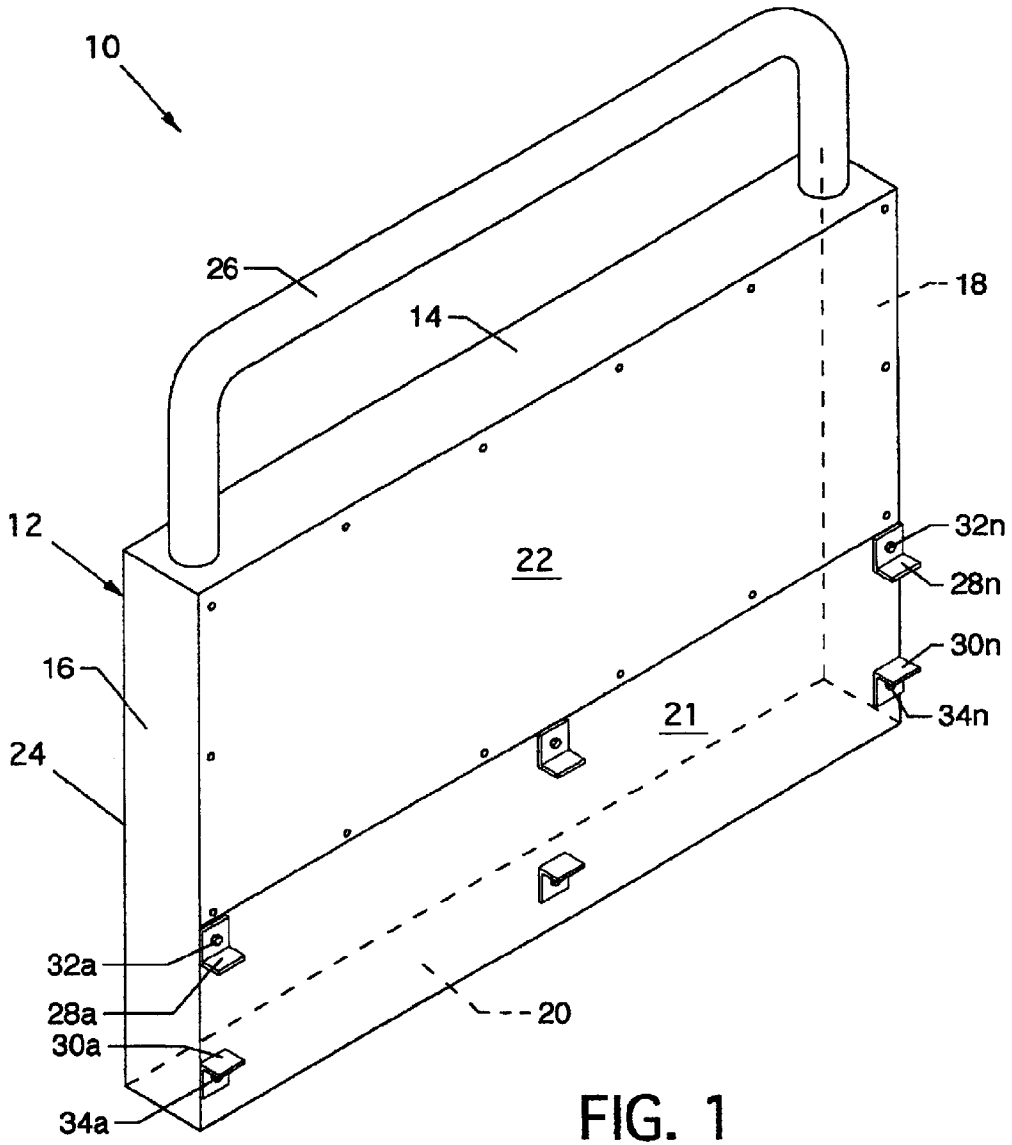
FIG. 1 illustrates an isometric rear view of an electronic sign enclosure having a rail, the present invention.

FIG. 1 illustrates an isometric rear view of an electronic sign enclosure having a rail 10, the present invention. The electronic sign enclosure having a rail 10 comprises an enclosure 12 and a rail 26. The enclosure 12 includes a top panel 14, opposing end panels 16 and 18, a bottom panel 20, a rear panel 21, a removable access panel 22 secured over and about and to the rear panel 21, and a removable front panel 24. The rail 26 secures to the top panel 14 of the enclosure 12. Preferably, the top panel 14, the opposing end panels 16 and 18, and the bottom panel 20 are of channel stock and may be positionally inverted or reversed, as shown in an alternate embodiment. Suitably spaced and opposing pluralities of upper brackets 28*a*–28*n* and lower brackets 30*a*–30*n* suitably secure, such as by nut and bolt assemblies 32*a*–32*n* and 34*a*–34*n*, to the lower region of the rear panel 21.

Figure 2:
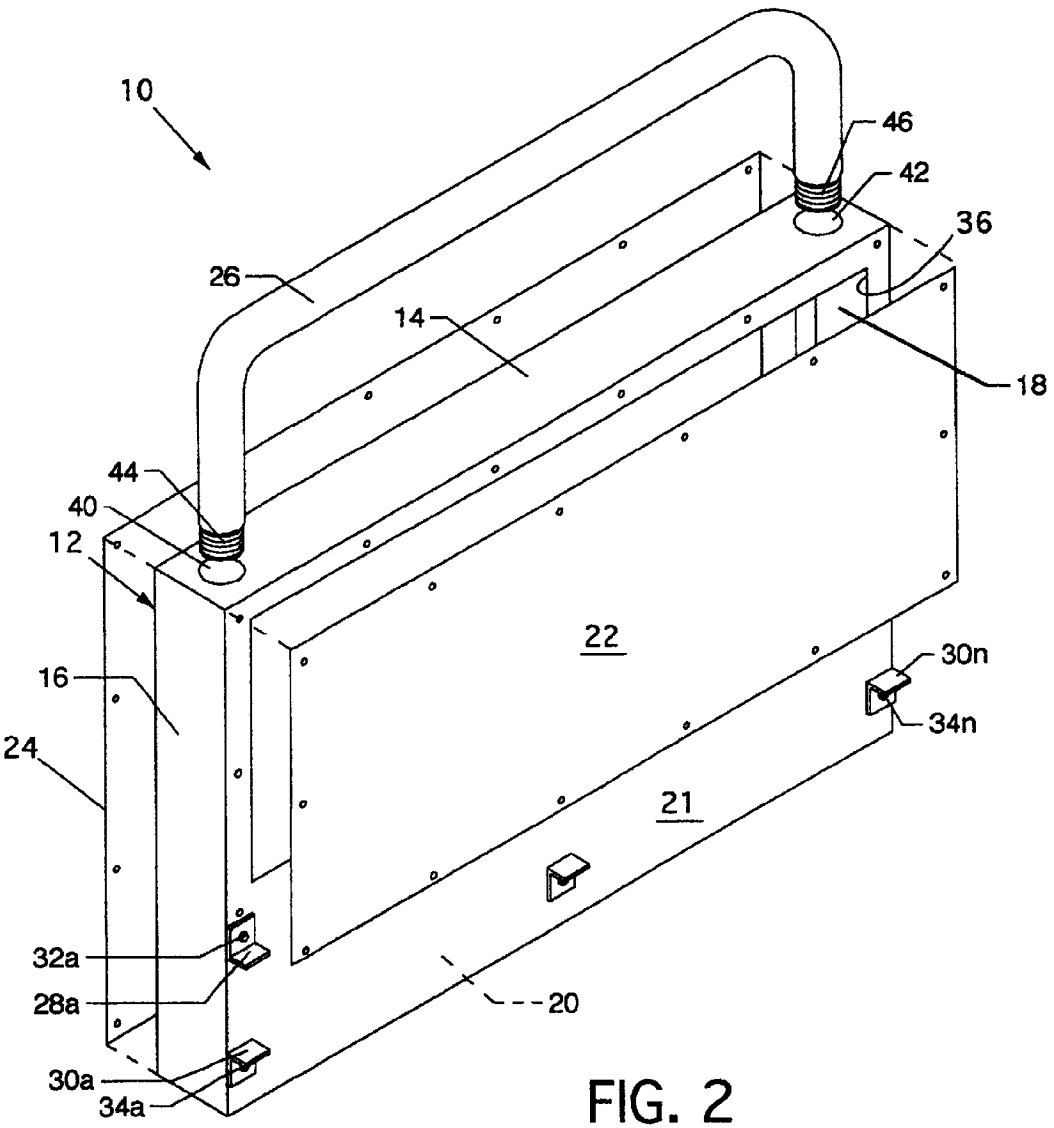
FIG. 2 illustrates an exploded isometric rear view of the electronic sign enclosure having a rail.

FIG. 2 illustrates an exploded isometric rear view of the electronic sign enclosure having a rail 10 generally extending to the end of the enclosure. In this view, an access cutout 36, which is normally covered by the access panel 22, is revealed. Access cutout 36 offers access to electronic components which can be housed in the enclosure 12. The front panel 24 is used for the mounting of desired electronic display (72) which can be viewed from the front of the invention. Holes 40 and 42 are included in the top panel 14 for mounting of the threaded ends 44 and 46 of the rail 26. The rail 26 is shown as tubular (see FIG. 3) and mounting threads are shown for purposes of example and illustration, but each can be of other suitable configuration to provide a rail which is mountable to the enclosure 12.

Figure 3:
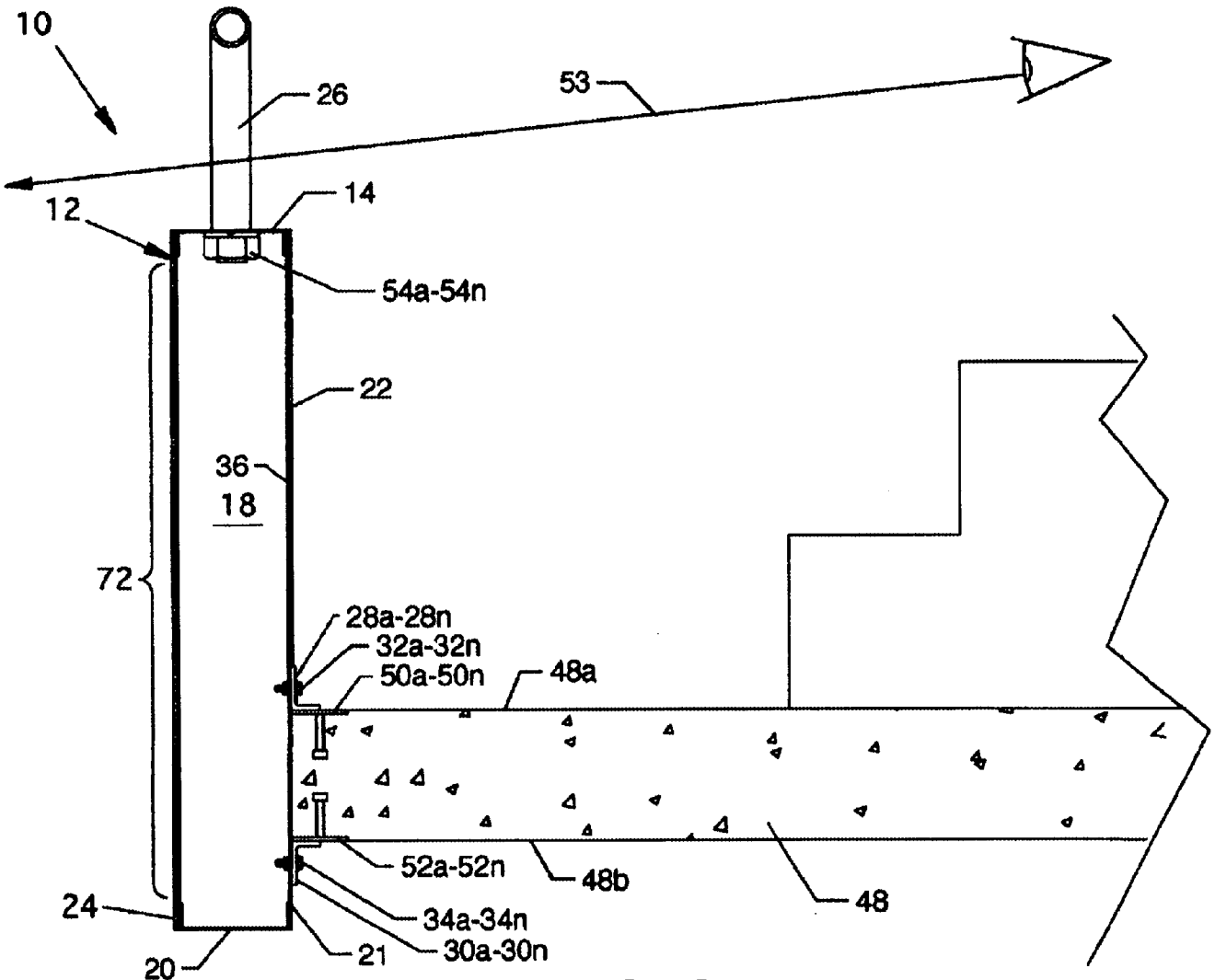
FIG. 3 illustrates an end view, in cross section, showing the electronic sign enclosure having a rail mounted to a concrete seating deck; and, FIG. 4, an alternative embodiment, illustrates an electronic sign enclosure with steel structure and a rail which are mounted by other means to a concrete seating deck.

FIG. 3 illustrates an end view, in cross section, of the electronic sign enclosure having a rail 10 mounted to a concrete seating deck 48. A plurality of upper and lower mounting plates 50*a*–50*n* and 52*a*–52*n*, respectively, are cast or otherwise secured to the upper and lower surfaces 48*a* and 48*b*, respectively, of the concrete seating deck 48. The pluralities of upper brackets 28*a*–28*n* and lower brackets 30*a*–30*n*, which are removable from the enclosure 12, are secured, such as by welding, to the upper and lower mounting plates 50*a*–50*n* and 52*a*–52*n*, respectively, to firmly secure the electronic enclosure having a rail 10 to the upper and lower surfaces 48*a* and 48*b*, respectively, of the concrete seating deck 48. The rear panel 21 of the electronic enclosure having a rail 10 firmly abuts the vertical edge of the concrete seating deck 48 to provide for additional stability. A plurality of nuts 54*a*–54*n* engage the threaded ends of the rail 26 to fasten the rail 26 to the enclosure 12. Such an installation provides for a personnel barrier and rail. Additionally, a sight line 53 is maintained between the rail 26 and the top panel 14.

Figure 4:
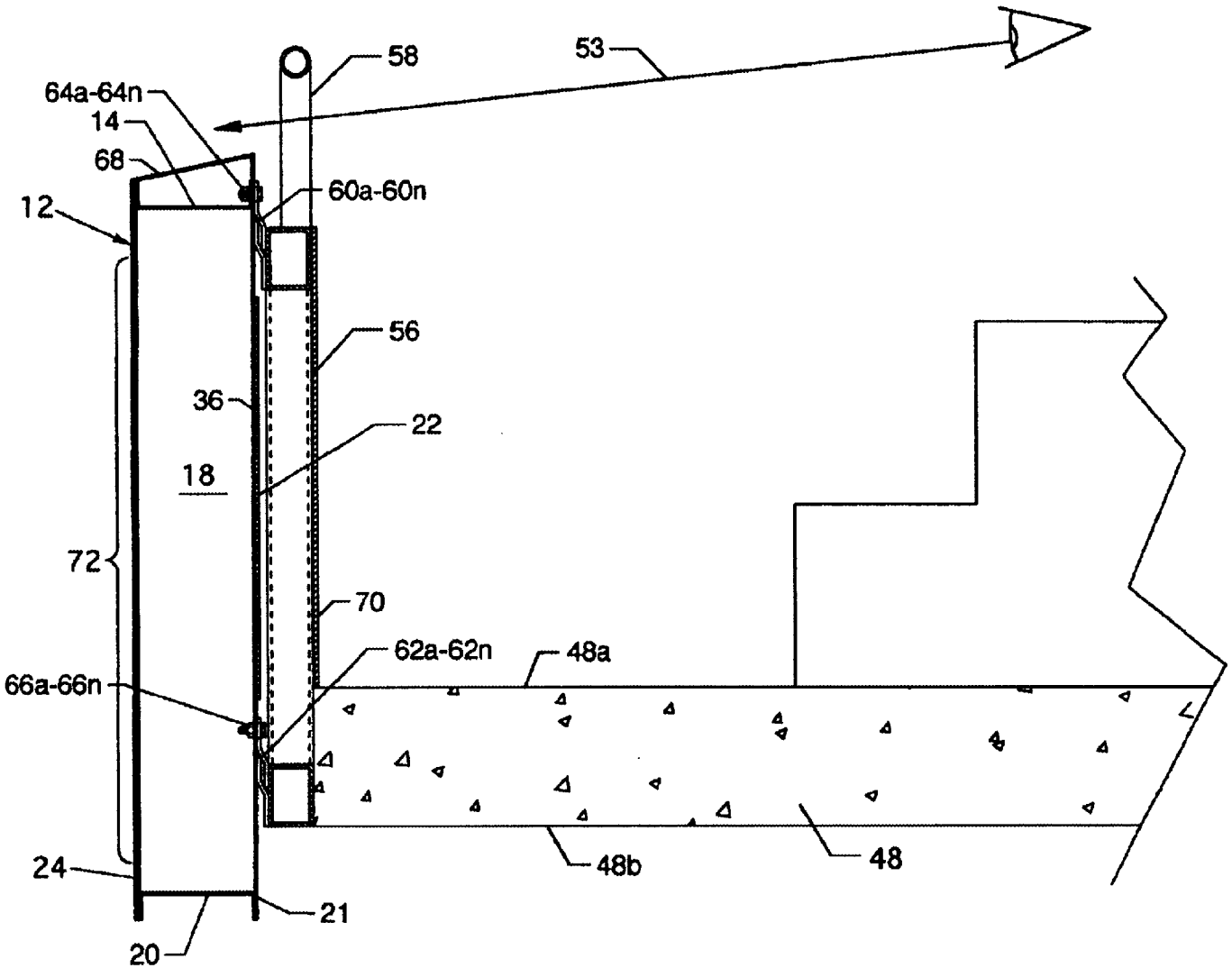

FIG. 4, an alternative embodiment, illustrates an electronic sign enclosure 12 with steel structure 56 and a rail 58 which are mounted by other means to a concrete seating deck 48. This alternative embodiment is substantially the same as the electronic sign enclosure having a rail 10, but in this alternative embodiment the rail 58 is displaced from the enclosure 12 and included on the steel structure 56, and the enclosure 12 has an angled top panel 68. A plurality of removable upper brackets 60*a*–60*n* and a plurality of removable lower brackets 62*a*–62*n* replace the upper brackets 28*a*–28*n* and lower brackets 30*a*–30*n*, shown in FIG. 1, and are welded to the steel structure 56 and are incorporated to secure the enclosure 12 to the steel structure 56 using a plurality of nut and bolt assemblies 64*a*–64*n* and 66*a*–66*n*. It is to be noted that the top panel 14 and the bottom panel 20 are inverted. The angled top panel 68 bridges the region between the upper areas of the front panel 24 and the rear panel 21. An anti-vandal panel 70 can also be attached to the steel structure 56.

Various modifications can be made to the present invention without departing from the apparent scope hereof.

It is claim:

1. In combination:

a. a structural member having an edge;

b. an electronic sign enclosure including a rear panel and a top panel, the rear panel having spaced opposing upper and lower brackets on a lower portion thereof, an access panel on an upper portion thereof, the upper and lower brackets being attached to the edge of the structural member; and, c. a rail, the rail being secured to the top panel.

2. An electronic sign enclosure having a rail which can be secured to an edge of a seating deck or balcony and act as a barrier, comprising:

a. a rearwardly facing enclosure surface having an access opening therein;

b. a series of upper and lower brackets located along the rearwardly facing enclosure surface, for securing to upper and lower surfaces at said edge of the seating deck or balcony;

c. an upper enclosure surface attached to said rearwardly facing enclosure surface and extending forwardly of said rearwardly facing enclosure surface;

d. a rail located along and attached directly to said upper enclosure surface; and, e. the rearwardly facing enclosure surface and the rail together being of sufficient height and strength to serve as a safety barrier to prevent people from accidentally falling over the edge of the seating deck or balcony, and said access opening in said rearwardly facing enclosure surface permitting access by maintenance personnel on the seating deck or balcony.

3. A barrier and electronic sign enclosure combination suitable for use at a leading edge of a seating deck structure, the combination comprising:

a. an enclosure including a front panel carrying an electronic display which, when the enclosure is mounted to the leading edge of the seating deck structure, will be directed away from the seating deck structure so as to be viewed from in front of the enclosure and the enclosure further including a top panel;

b. a rail generally extending to the end of the enclosure mounted directly to the top panel of the enclosure and, when the enclosure is mounted to the leading edge of the seating deck structure, providing a sight line from the seating deck structure over the top panel of the enclosure and under the rail; and, c. the enclosure being of sufficient height and strength to serve, when mounted to the leading edge of the seating deck structure, as a safety barrier to prevent people from accidentally falling over the leading edge of the seating deck structure, and the rail having sufficient strength and extending above the top panel of the enclosure a sufficient distance to provide increased height and strength to the safety barrier to further assist in preventing people from accidentally falling over the leading edge of the seating deck structure.

4. The barrier and electronic sign enclosure combination of claim 3, wherein the front panel is removable.

5. The barrier and electronic sign enclosure combination of claim 3, wherein the rail is tubular.

6. The barrier and electronic sign enclosure combination of claim 3, wherein the rail is U-shaped.

7. The barrier and electronic sign enclosure combination of claim 6, wherein the ends of the U-shaped rail are threaded.

8. The barrier and electronic sign enclosure combination of claim 7, further including nuts engaging the threaded ends of the U-shaped rail and thereby fastening the U-shaped rail to the top panel of the enclosure.

9. The barrier and electronic sign enclosure combination of claim 3, wherein the enclosure further includes a rear panel.

10. The barrier and electronic sign enclosure combination of claim 9, wherein the rear panel has an access cutout.

11. The barrier and electronic sign enclosure combination of claim 10, wherein the access cutout is covered by an access panel.

12. The barrier and electronic sign enclosure combination of claim 11, wherein the access panel is removable.

13. The barrier and electronic sign enclosure combination of claim 10, wherein the access cutout offers access to the electronic components housed in the enclosure.

14. The barrier and electronic sign enclosure combination of claim 9, further comprising upper brackets on the rear panel for secure attachment to an upper surface of the seating deck structure.

15. The barrier and electronic sign enclosure combination of claim 9, further comprising lower brackets on the rear panel for secure attachment to a lower surface of the seating deck structure.

16. The barrier and electronic sign enclosure combination of claim 9, further comprising upper brackets and lower brackets on the rear panel for secure attachment to upper and lower surfaces, respectively, of the seating deck structure.

17. The barrier and electronic sign enclosure combination of claim 3, wherein the enclosure further includes opposing end panels.

18. The barrier and electronic sign enclosure combination of claim 3, wherein the enclosure further includes a bottom panel.

19. The barrier and electronic sign enclosure combination of claim 3, wherein the top panel includes channel stock.

20. In combination:

a. a seating deck structure having an upper surface, a lower surface, and a leading edge, the upper surface having a plurality of upper mounting plates secured thereto along said leading edge and the lower surface having a plurality of lower mounting plates secured thereto along said leading edge;

b. an electronic sign enclosure including a front panel adapted for mounting an electronic display, a rear panel, and a top panel, said rear panel having a plurality of upper mounting brackets and a plurality of lower mounting brackets;

c. a rail for preventing accidental falls of people from the seating deck structure, the rail being mounted to the electronic sign enclosure; and, d. said upper and lower mounting brackets on said rear panel of said electronic sign enclosure being respectively attached to said upper and lower mounting plates on the upper and lower surfaces of said seating deck structure along said leading edge of said seating deck structure with a line of sight being provided from the seating deck structure over the top panel of the electronic sign enclosure and under the rail.

21. The combination of claim 20, wherein the seating deck structure is concrete and the pluralities of upper and lower mounting plates are cast into the upper and lower surfaces, respectively.

22. The combination of claim 20, wherein the upper mounting brackets are welded to the upper mounting plates and the lower mounting brackets are welded to the lower mounting plates.

23. The combination of claim 20, further comprising an electronic display mounted on the front panel and directed away from the seating deck structure and wherein the rear panel has an access cutout, the access cutout being covered by a removable access panel, the removable access panel being above the upper mounting brackets and offering access through the access cutout to electronic components of the electronic display which are housed in the electronic sign enclosure without separating the electronic sign enclosure from the seating deck structure.

* * * * *